United States Patent [19]

Best

[11] Patent Number: 4,858,920

[45] Date of Patent: Aug. 22, 1989

[54] SCORE-SENSITIVE BASKETBALL HOOP

[76] Inventor: Jerry L. Best, 1706 Spoon Bill Dr., Nokomis, Fla. 34275

[21] Appl. No.: 231,265

[22] Filed: Aug. 12, 1988

[51] Int. Cl.[4] ..... A63B 63/08

[52] U.S. Cl. ..... 273/1.5 R; 273/371

[58] Field of Search ..... 273/1.5 R, 371, 1 F

[56] References Cited

U.S. PATENT DOCUMENTS

| | | | |
|---|---|---|---|
| 2,061,152 | 11/1936 | Guthrie | 273/1.5 R |
| 2,534,067 | 12/1950 | Rubin | 273/1.5 R |
| 2,658,495 | 11/1953 | Elliott, Sr. | 273/1.5 R X |
| 2,916,287 | 12/1959 | Davey | 273/1 F |
| 2,999,233 | 9/1961 | Dresbach et al. | 273/1.5 R X |
| 3,137,503 | 6/1964 | Ballard | 273/1.5 R |
| 3,771,786 | 11/1973 | Bouldin | 273/1 F X |
| 3,856,302 | 12/1974 | Karkoska | 273/371 X |
| 3,920,242 | 11/1975 | Reith et al. | 273/1 F |
| 4,013,292 | 3/1977 | Cohen et al. | 273/371 |

FOREIGN PATENT DOCUMENTS

| | | | |
|---|---|---|---|
| 1021369 | 11/1977 | Canada | 273/1.5 R |

*Primary Examiner*—Paul E. Shapiro

*Attorney, Agent, or Firm*—Gifford, Groh, Sheridah, Sprinkle and Dolgorukov

[57] ABSTRACT

A score-sensitive basketball hoop apparatus is provided for sensing then announcing the by-passage of a basketball through the hoop. The sensor comprises a transmitting light and a photoelectric cell. When a ball passes through the hoop the transmitted beam of light is broken. A broken beam is detected and the by-passage of the ball through the hoop is signalled by lights fixed to the hoop and the score is registered on a scoreboard.

4 Claims, 2 Drawing Sheets

SCORE-SENSITIVE BASKETBALL HOOP

BACKGROUND OF THE INVENTION

I. Field of the Invention

The present invention relates to a score-sensitive basketball hoop apparatus, and particular relates to a score-sensitive basketball hoop apparatus for sensing when announcing the by-passage of a basketball through a basketball hoop. The sensor comprises a transmitting light and a photoelectric cell.

II. Description of the Relevant Art

In the game of basketball, the basketball hoop is conventional and is well known. The basketball hoop conventionally known comprises a backboard fitted to a backboard support. The backboard has mounted thereto a basketball rim which has suspended from its lower periphery the basketball net.

As is known, a point is scored in basketball when the basketball passes into then through the basketball rim. Once the basketball bypasses the rim, a point is achieved.

However, tallying points in basketball is done manually by a score keeper. While this method may be acceptable for more formal tournaments or formal basketball games, persons interested in the casual playing of basketball have no advantage of relying on a scorekeeper to tally the scores and otherwise post the scores for the benefit of the players as well as any present audience. This inefficient approach to accounting for scores has led to the frustration of many players who otherwise might wish to rely on an alternative means of tallying scores.

SUMMARY OF THE INVENTION

The present invention relates to a score-sensitive basketball hoop apparatus for sensing then announcing the by-passage of a basketball through the basketball hoop. The sensor comprises a transmitting light and a photoelectric cell. When a ball passes through the hoop, the transmitted beam of light is broken. The broken beam of light is detected by the sensor and the by-passage of the ball through the hoop is signalled by lights fixed through the outer periphery of the hoop and the score is registered on a scoreboard.

To eliminate false readings, a timer is fixed to the sensor which requires the light beam to be broken for a predetermined amount of time, specifically that time required for a basketball-sized object to pass completely before a beam of light.

When the sensor determines that a basketball has indeed passed completely through the hoop thereby warranting a point, two events simultaneously occur. One of those events is the flashing or lighting up of a ring of lights provided around the periphery of the rim to thereby visually announce with some fanfare the bypassage of the ball through the hoop. The other event is that the point is counted by a counter and the point is thereafter registered on a scoreboard.

By the afore-described design, a practical and efficient method is provided for tallying and announcing points scored in a basketball game.

BRIEF DESCRIPTION OF THE DRAWINGS

The various features, advantages and other uses of the present invention will become more apparent by referring to the following detailed description and drawings in which.

DETAILED DESCRIPTION OF THE PREFERRED EMBODIMENT

FIGS. 1–6 illustrate preferred embodiments of the present invention. While the configuration according to the illustrated embodiments is preferred, it is envisioned that alternate configurations of the present invention may be adopted without departing from the invention as portrayed. The preferred embodiments are discussed hereafter.

Figure 1:
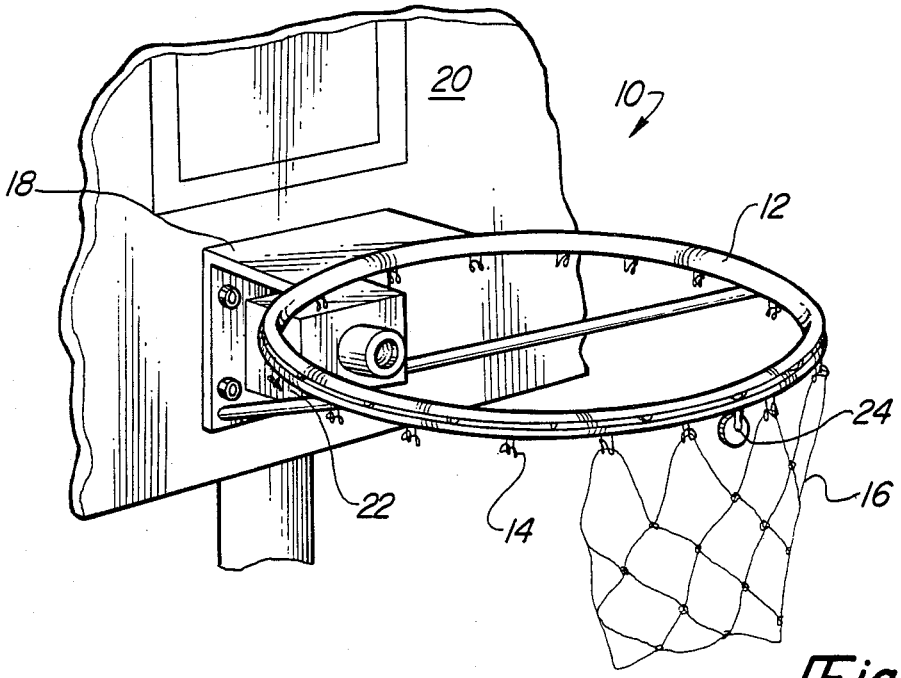
FIG. 1 is a perspective view of a preferred embodiment of a score-sensitive basketball hoop apparatus according to the present invention.

Referring to FIG. 1, there is shown a perspective view of a score-sensitive basketball hoop apparatus generally indicated by 10 according to the present invention. The hoop apparatus 10 comprises a hoop body 12 having suspended therefrom a number of hooks 14 for holding a net 16, partially illustrated.

Fitted to the hoop body 12 is a hoop body support bracket 18 which fixes the hoop apparatus 10 to a conventional basketball hoop backboard 20.

On the front side of the bracket 18 is fixed a light emitter unit 22 which emits a beam of light while the unit is in use. The beam of light is received and its continued presence detected by a photoelectric unit 24.

While conventional, incandescent-light producing elements are illustrated, it is certainly conceivable that other forms of light, including laser light, may be utilized.

Figure 2:
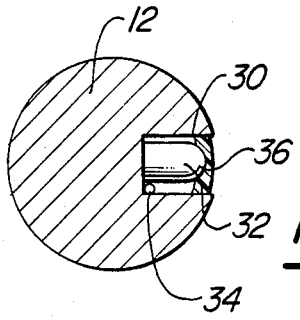
FIG. 2 is a section of the basketball hoop rim shown in cross section.

With reference to FIG. 2, a portion of the hoop body 12 is shown in cross-section. A channel 30 is defined around the periphery of the hoop body 12 in which a number of flashing units 32 are interiorly provided. The units 32 are selectively interconnected by a unit wire 34. To protect against damage to the units 32 and their accompanying wire 34, the channel is preferably covered by a clear protective cover 36. The cover 36 is preferably composed of a clear, durable polymerizable compound.

The flashing units 32 are preferably conventional incandescent lamps, but may be light-emitting diodes. The lamps are used to visually signal a scored point and may either flash simultaneously, independently, or in sequence when a point is scored. The units 32 stay on for 3–5 seconds to announce the scored point. Of course, this amount of time may be varied, as the light may be left on for a brief moment or from an indefinite time. In addition to the light signal a horn (not shown) or a buzzer (not shown) may be provided.

Figure 3:
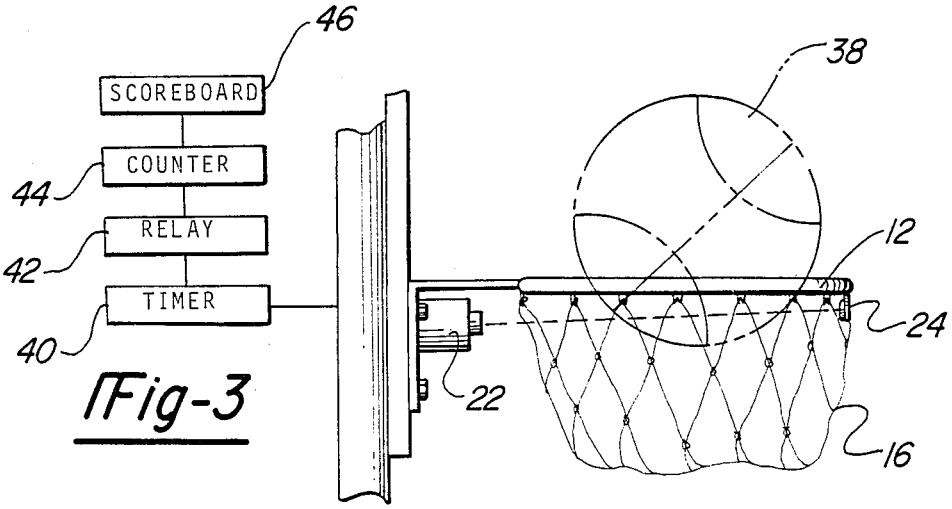
FIG. 3 is a side elevational view showing a basketball bypassing the rim and breaking a beam of light according to the present invention.

With reference to FIG. 3, a ball 38 is shown in broken lines to illustrate where it would need to be to break a beam of light transmitted from emitter unit 22 to photoelectric unit 24.

When the ball 38 passes through the hoop body 12 as illustrated, a signal is sent from the emitter unit 22 to a timer 40. The timer 40 measures the amount of time during which the photoelectric unit 24 is not receiving transmitted light. If the measure is sufficient to account for a basketball-sized object as the interrupting object, the timer determines that a point is scored and the ball did not simply partially enter the hoop body 12 and bounce out without fully passing therethrough.

In the event that a scored point is acknowledged by the timer, two events occur simultaneously. One event is that the timer signals the flashing unit 32 to flash as described above. The other event is that the timer signals a relay 42 which in turn signals a counter 44 that a point has been scored. The counter 44 tallies the scored points and signals the same to a scoreboard 46.

Figure 4:
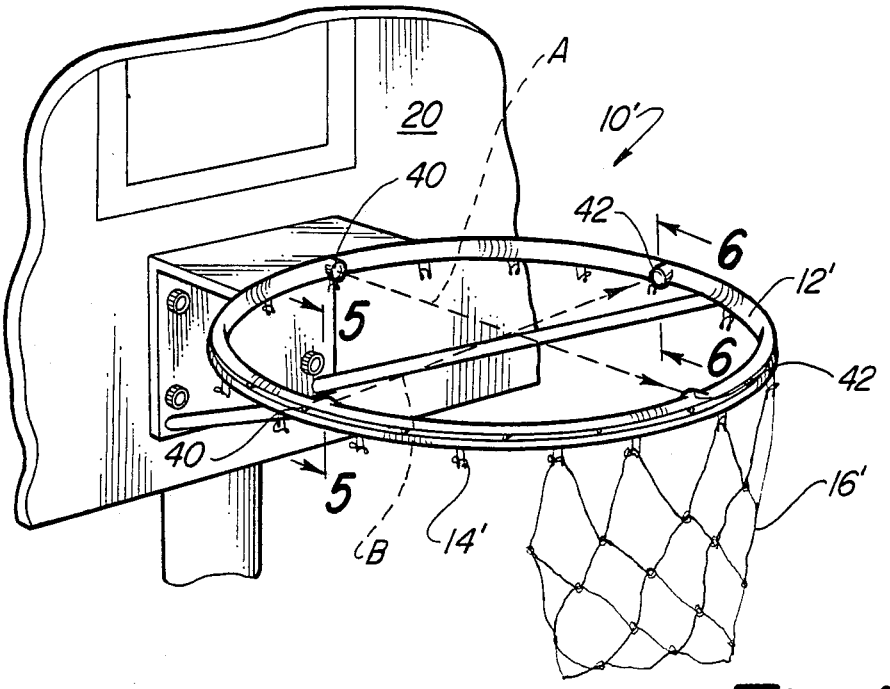
FIG. 4 is a perspective view of an alternate embodiment of a score-sensitive basketball hoop apparatus according to the present invention.
Figure 5:
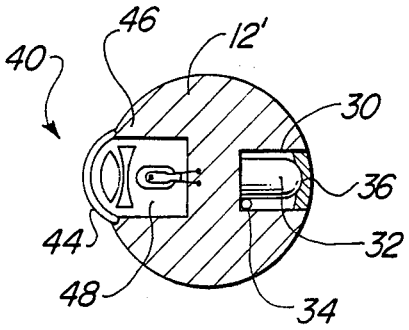
FIG. 5 is a cross section taken along line 5—5 of FIG. 4.
Figure 6:
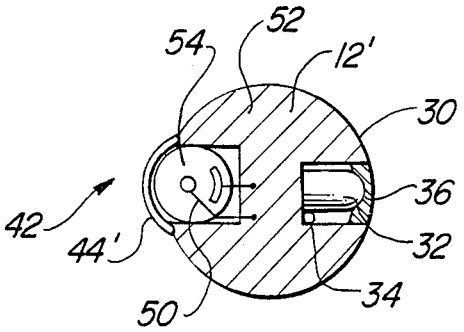
FIG. 6 is a cross section taken along line 6—6 of FIG. 4.

An alternate embodiment of the present invention is set forth in FIGS. 4–6. With reference to FIG. 4, a basketball hoop apparatus, generally indicated by 10', is shown. The hoop apparatus 10' comprises a hoop body 12' having suspended therefrom a number of hooks 14' for holding net 16'.

The hoop body 12' has embedded therein two light transmitters 40 and a corresponding number of photoelectric cells 42. The broken lines A, B indicate the light beams emitted from the transmitters 40 for reception by the cells 42. A basketball passing therethrough breaks the beams A, B, thereby announcing a basket in the same manner as discussed above with respect to the embodiment of FIGS. 1–3.

With reference to FIG. 5, the hoop 12' is shown in section to reveal the components of the light emitter 40 in cross section as well as the light announcing components described above with respect to FIGS. 1–3. The transmitter 40 comprises a protective cover 44, a compound focusing lens 46 to focus and direct the light beam and a light source 48.

The focused light beam emitted by the emitter 40 is received by a photoelectric unit 42, illustrated in FIG. 6. With reference thereto, the component parts of the photoelectric unit 42 comprises an anode 50, a cathode 52, and an encapsulating photoelectric cell 54. The cell 54 is protected by a protective cover 44'. The activation and deactivation of the embodiment described with respect to FIGS. 4–6 is the same as that described above with respect to FIGS. 1–3.

Having set forth the present invention and what is considered to be the best embodiments thereof, it will be understood that changes may be made from the specific embodiments set forth without departing from the spirit of the invention exceeding the scope thereof as defined in the following claims.

I claim:

1. A score-sensitive basketball hoop apparatus comprising:

a hoop portion including a rim and a base;

means for sensing the by-passage of a ball through said hoop portion;

means for signalling said sensed by-passage of said ball;

means for counting the number of times said ball by-passes said hoop;

means for relaying said sensed by-passage of said ball to said counting means;

said means for counting comprising a counter, said counter being interconnected with a scoreboard;

said means for signalling including means for visually signalling said by-passage through said hoop by said ball; and said means for visually signalling comprising lighting units fixed in said rim.

2. A score-sensitive basketball hoop according to claim 1 wherein said rim has one or more channels defined therein for accomodating said lighting units.

3. A score-sensitive basketball hoop according to claim 2 wherein said one or more channels includes substantially clear lamp-covering material.

4. A score-sensitive basketball hoop apparatus comprising:

a hoop portion including a rim and a base;

means for sensing the by-passage of a ball through said hoop portion;

means for signalling said sensed by-passage of said ball;

said means for signalling including means for visually signalling said by-passage through said hoop by said ball; and said means for visually signalling comprising lighting units fixed in said rim.

* * * * *

UNITED STATES PATENT AND TRADEMARK OFFICE

CERTIFICATE OF CORRECTION

PATENT NO. : 4,858,920

DATED : August 22, 1989

INVENTOR(S) : Jerry L. Best

It is certified that error appears in the above-identified patent and that said Letters Patent is hereby corrected as shown below:

Column 1, line 9, delete "when" and insert --then--.

Column 2, line 25, delete "departing" and insert --deviating--.

Column 2, line 62, delete "from" and insert --for--.

Signed and Sealed this

Sixth Day of August, 1991

*Attest:*

HARRY F. MANBECK, JR.

*Attesting Officer*

*Commissioner of Patents and Trademarks*